US011396312B2

(12) United States Patent
Ouyang et al.

(10) Patent No.: US 11,396,312 B2
(45) Date of Patent: Jul. 26, 2022

(54) TRAIN OVERSPEED PROTECTION METHOD AND APPARATUS

(71) Applicant: BYD COMPANY LIMITED, Guangdong (CN)

(72) Inventors: Shengcong Ouyang, Shenzhen (CN); Bo Su, Shenzhen (CN); Faping Wang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 508 days.

(21) Appl. No.: 16/472,658

(22) PCT Filed: Dec. 20, 2017

(86) PCT No.: PCT/CN2017/117395
§ 371 (c)(1),
(2) Date: Jun. 21, 2019

(87) PCT Pub. No.: WO2018/113689
PCT Pub. Date: Jun. 28, 2018

(65) Prior Publication Data

US 2019/0359237 A1 Nov. 28, 2019

(30) Foreign Application Priority Data

Dec. 21, 2016 (CN) ..... 201611191094.0

(51) Int. Cl.
*G05D 3/00* (2006.01)
*B61L 3/08* (2006.01)
(Continued)

(52) U.S. Cl.
CPC ..... *B61L 25/025* (2013.01); *B61L 3/008* (2013.01); *B61L 25/021* (2013.01)

(58) Field of Classification Search
None
See application file for complete search history.

(56) References Cited

U.S. PATENT DOCUMENTS 3,794,833 A * 2/1974 Blazek ..... B61L 3/221 246/63 C
7,395,141 B1 * 7/2008 Seek ..... B61C 17/12 246/182 R
(Continued)

FOREIGN PATENT DOCUMENTS

CN 101927768 A 12/2010
CN 102649438 A 8/2012
(Continued)

OTHER PUBLICATIONS

English Translation of International Search Report from PCT/CN2017/117395 dated Mar. 21, 2018 (2 pages).

*Primary Examiner* — Adam D Tissot
(74) *Attorney, Agent, or Firm* — Calfee Halter & Griswold LLP

(57) ABSTRACT

A train overspeed protection method includes: acquiring, when emergency braking is triggered for a train, an initial speed limit location point of each speed limit region among a preset number of speed limit regions, and a first speed limit value corresponding to each initial speed limit location point so as to obtain a plurality of first speed limit values; acquiring a current traveling location point of the train and a corresponding second speed limit value, and acquiring a current traveling speed of the train; determining a plurality of decelerations of the current traveling speed relative to each first speed limit value, selecting a deceleration satisfying a preset condition from the plurality of decelerations, and determining the initial speed limit location point corresponding to the deceleration satisfying the preset condition as a target speed limit location point; determining an emergency braking speed according to a relative deceleration of the second speed limit value relative to the first speed limit value corresponding to the target speed limit location point,
(Continued)

and performing overspeed protection on the train according to the emergency braking speed.

10 Claims, 4 Drawing Sheets

(51) Int. Cl.

| | |
|---|---|
| ***B60K 7/00*** | (2006.01) |
| ***B61L 25/02*** | (2006.01) |
| ***B61L 3/00*** | (2006.01) |

(56) References Cited

U.S. PATENT DOCUMENTS

| | | | | |
|---|---|---|---|---|
| 8,655,519 | B2 * | 2/2014 | Cooper | B61L 3/008 701/20 |
| 2009/0177344 | A1 | 7/2009 | James et al. | |
| 2010/0299007 | A1 | 11/2010 | Ghaly | |
| 2015/0307119 | A1 | 10/2015 | Ghaly | |

FOREIGN PATENT DOCUMENTS

| | | | |
|---|---|---|---|
| CN | 102649439 | A | 8/2012 |
| CN | 103529703 | A | 1/2014 |
| CN | 103552555 | A | 2/2014 |
| CN | 103559419 | A | 2/2014 |
| CN | 105329264 | A | 2/2016 |
| CN | 105667544 | A | 6/2016 |

* cited by examiner

TRAIN OVERSPEED PROTECTION METHOD AND APPARATUS

CROSS-REFERENCE TO RELATED APPLICATIONS

This application is the U.S. national phase entry of PCT Application No. PCT/CN2017/117395, filed Dec. 20, 2017, which claims priority to Chinese Patent Application Serial No. CN201611191094.0, filed with the State Intellectual Property Office of P. R. China on Dec. 21, 2016. The entire contents of the above-referenced applications are incorporated herein by reference.

FIELD

The present subject matter relates to the field of rail transit communication signal technology, and particularly to a train overspeed protection method and apparatus.

BACKGROUND

With the continuous development of communication signal technology for rail transit, the safe and efficient operation of trains is particularly important. In the related art, the train is regarded as a mass point, and whether the train will exceed the front speed limit or authorized operation region is judged by segmented calculation with the use of a kinetic energy equation according to different speed limit segments.

Due to the inherent mechanical and physical characteristics of the train, the train does not decelerate with the desired deceleration motion in reality, which cannot truly reflect the actual operation of the train and will cause large calculation error and reduce the driving safety and efficiency. In order to ensure the safety of the train, only the running interval between trains is increased.

SUMMARY

In one aspect, the present subject matter is to provide a train overspeed protection method, which can effectively improve the accuracy of emergency braking speed calculation, reduce the calculation cycle, improve the traveling safety and efficiency of a train, and improve riding comfort for users.

In another aspect, the present subject matter is to provide a train overspeed protection apparatus.

A train overspeed protection method according to an embodiment of a first aspect of the present subject matter includes: acquiring, when emergency braking is triggered for a train, an initial speed limit location point of each speed limit region among a preset number of speed limit regions, and a first speed limit value corresponding to each initial speed limit location point so as to obtain a plurality of first speed limit values; acquiring a current traveling location point of the train and a corresponding second speed limit value, and acquiring a current traveling speed of the train; determining a plurality of decelerations of the current traveling speed relative to each first speed limit value according to the initial speed limit location points, the plurality of first speed limit values, the current traveling location point and the current traveling speed, selecting a deceleration satisfying a preset condition from the plurality of decelerations, and determining the initial speed limit location point corresponding to the deceleration satisfying the preset condition as a target speed limit location point; determining a relative deceleration of the corresponding second speed limit value relative to the first speed limit value corresponding to the target speed limit location point, and determining the relative deceleration as a target deceleration; determining an emergency braking speed according to the target deceleration, and performing overspeed protection on the train according to the emergency braking speed.

According to the train overspeed protection method proposed by the embodiment of the first aspect of the present subject matter, when emergency braking is triggered for a train, an initial speed limit location point of each speed limit region among a preset number of speed limit regions, and a first speed limit value corresponding to each initial speed limit location point are acquired so as to obtain a plurality of first speed limit values; a current traveling location point of the train and a corresponding second speed limit value are acquired, and a current traveling speed of the train is acquired; the initial speed limit location point corresponding to a deceleration satisfying a preset condition among a plurality of decelerations of the current traveling speed relative to each first speed limit value is determined as a target speed limit location point; an emergency braking speed is determined according to a relative deceleration of the second speed limit value relative to the first speed limit value corresponding to the target speed limit location point, and overspeed protection is performed on the train according to the emergency braking speed, thereby effectively improving the accuracy of emergency braking speed calculation, reducing the calculation cycle, improving the traveling safety and efficiency of the train, and improving riding comfort for users.

A train overspeed protection apparatus according to an embodiment of a second aspect of the present subject matter includes: a first acquisition module, configured to acquire, when emergency braking is triggered for a train, an initial speed limit location point of each speed limit region among a preset number of speed limit regions, and a first speed limit value corresponding to each initial speed limit location point so as to obtain a plurality of first speed limit values; a second acquisition module, configured to acquire a current traveling location point of the train and a corresponding second speed limit value, and acquire a current traveling speed of the train; a first determination module, configured to determine a plurality of decelerations of the current traveling speed relative to each first speed limit value according to the initial speed limit location points, the plurality of first speed limit values, the current traveling location point and the current traveling speed, select a deceleration satisfying a preset condition from the plurality of decelerations, and determine the initial speed limit location point corresponding to the deceleration satisfying the preset condition as a target speed limit location point; a second determination module, configured to determine a relative deceleration of the corresponding second speed limit value relative to the first speed limit value corresponding to the target speed limit location point, and determine the relative deceleration as a target deceleration; and a protection module, configured to determine an emergency braking speed according to the target deceleration, and perform overspeed protection on the train according to the emergency braking speed.

According to the train overspeed protection apparatus proposed by the embodiment of the second aspect of the present subject matter, when emergency braking is triggered for a train, an initial speed limit location point of each speed limit region among a preset number of speed limit regions, and a first speed limit value corresponding to each initial speed limit location point are acquired so as to obtain a plurality of first speed limit values; a current traveling location point of the train and a corresponding second speed limit value are acquired, and a current traveling speed of the train is acquired; the initial speed limit location point corresponding to a deceleration satisfying a preset condition among a plurality of decelerations of the current traveling speed relative to each first speed limit value is determined as a target speed limit location point; an emergency braking speed is determined according to a relative deceleration of the second speed limit value relative to the first speed limit value corresponding to the target speed limit location point, and overspeed protection is performed on the train according to the emergency braking speed, thereby effectively improving the accuracy of emergency braking speed calculation, reducing the calculation cycle, improving the traveling safety and efficiency of the train, and improving riding comfort for users.

The embodiment of the second aspect of the present subject matter proposes a computer readable non-transitory storage medium storing executable instructions that, when executed by a processor, implement the method according to the first aspect of the present subject matter.

Additional aspects and advantages of the present subject matter will be partially given in the following description, and part of them will become apparent in the following description, or may be learned by practice of the present subject matter.

BRIEF DESCRIPTION OF THE DRAWINGS

The above and/or additional aspects and advantages of the present subject matter will become apparent and be easily understood from the following description of embodiments in combination with the accompanying drawings, wherein.

DETAILED DESCRIPTION

The following describes in detail embodiments of the present subject matter. Examples of the embodiments are shown in the accompanying drawings, where reference signs that are the same or similar from beginning to end represent same or similar components or components that have same or similar functions. The embodiments described below with reference to the drawings are exemplary, are merely used to interpret the present subject matter, and should not be construed as limitations to the present subject matter. Conversely, the embodiments of the present subject matter cover all variations, modifications and equivalents within the spirit and scope of the appended claims.

Figure 1:
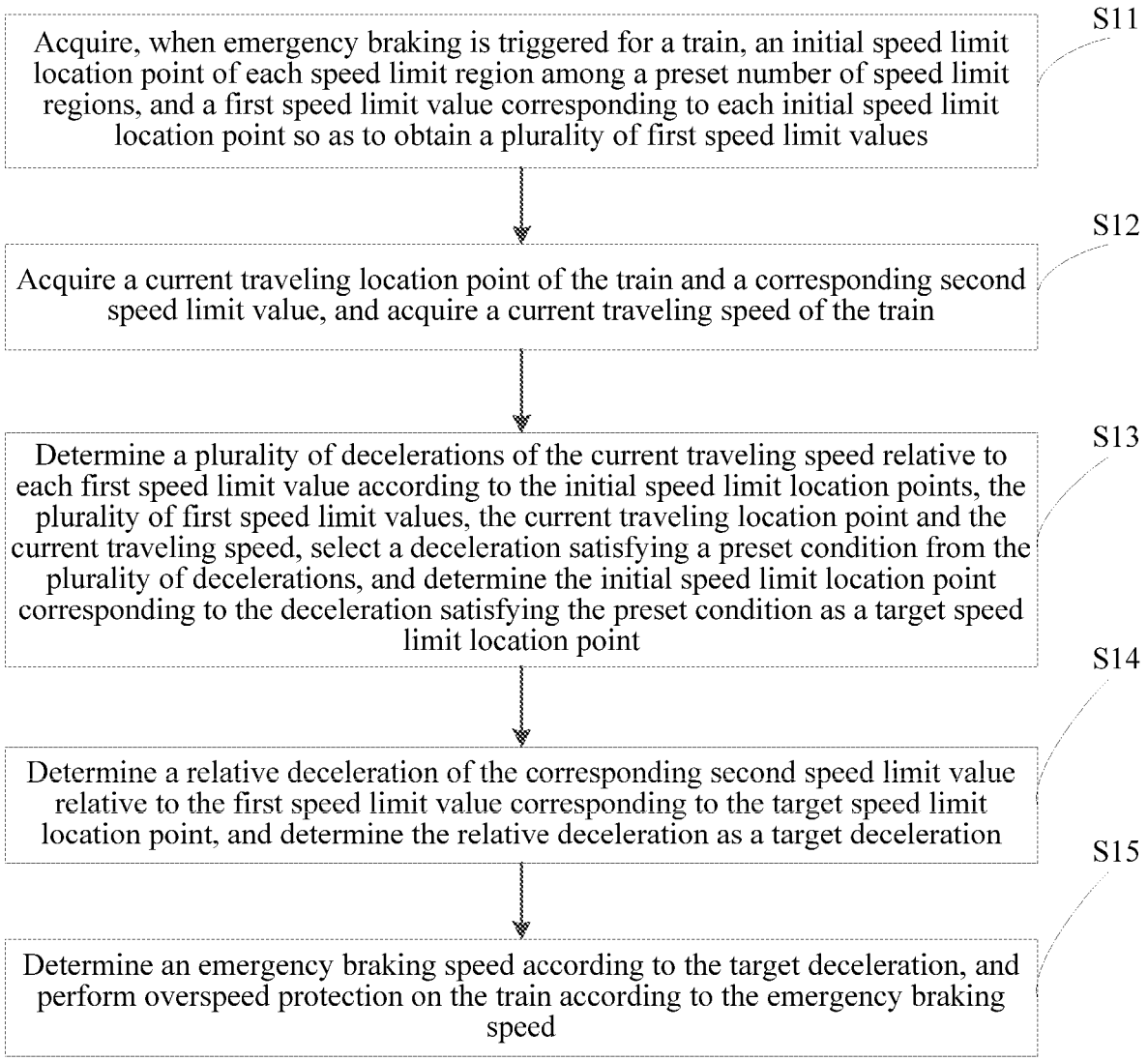
FIG. 1 is a schematic flow diagram of a train overspeed protection method according to an embodiment of the present subject matter.

FIG. 1 is a schematic flow diagram of a train overspeed protection method according to an embodiment of the present subject matter. This embodiment is exemplified by the train overspeed protection method being configured in a train overspeed protection apparatus.

Referring to FIG. 1, the train overspeed protection method includes:

S11: when emergency braking is triggered for a train, an initial speed limit location point of each speed limit region among a preset number of speed limit regions, and a first speed limit value corresponding to each initial speed limit location point are acquired so as to obtain a plurality of first speed limit values.

The method for calculating an emergency braking speed in the prior art has a large error, is cumbersome in calculation, has a long calculation cycle, easily triggers braking frequently, is not conducive to energy-saving control of a train, and cannot improve riding comfort for users.

In the embodiment of the present subject matter, a target speed limit location point may be confirmed through an electronic map and a mobile authorized location, and an emergency braking speed is determined according to a deceleration between a minimum speed limit value of a current traveling location point of the train and a speed limit value corresponding to the target speed limit location point, thereby effectively improving the accuracy of emergency braking speed calculation, reducing the calculation cycle, improving the traveling safety and efficiency of the train, and improving riding comfort for users.

In the embodiment of the present subject matter, the preset number is set in advance, and may be set by related technical staff in a train control center, or by a driver of the train, which is not limited herein.

The embodiment of the present subject matter is exemplified by a preset number 3.

In the embodiment of the present subject matter, an initial speed limit location point of each speed limit region among a preset number of speed limit regions, and a first speed limit value corresponding to each initial speed limit location point may be acquired through an electronic map or coordinates, for example, initial speed limit location points of three speed limit regions may be respectively marked as $object_1$, $object_2$ and $object_3$, and first speed limit values corresponding to the initial speed limit location points $objects_1$, $object_2$ and $object_3$ are respectively $v_1$, $v_2$ and $v_3$.

Figure 2:
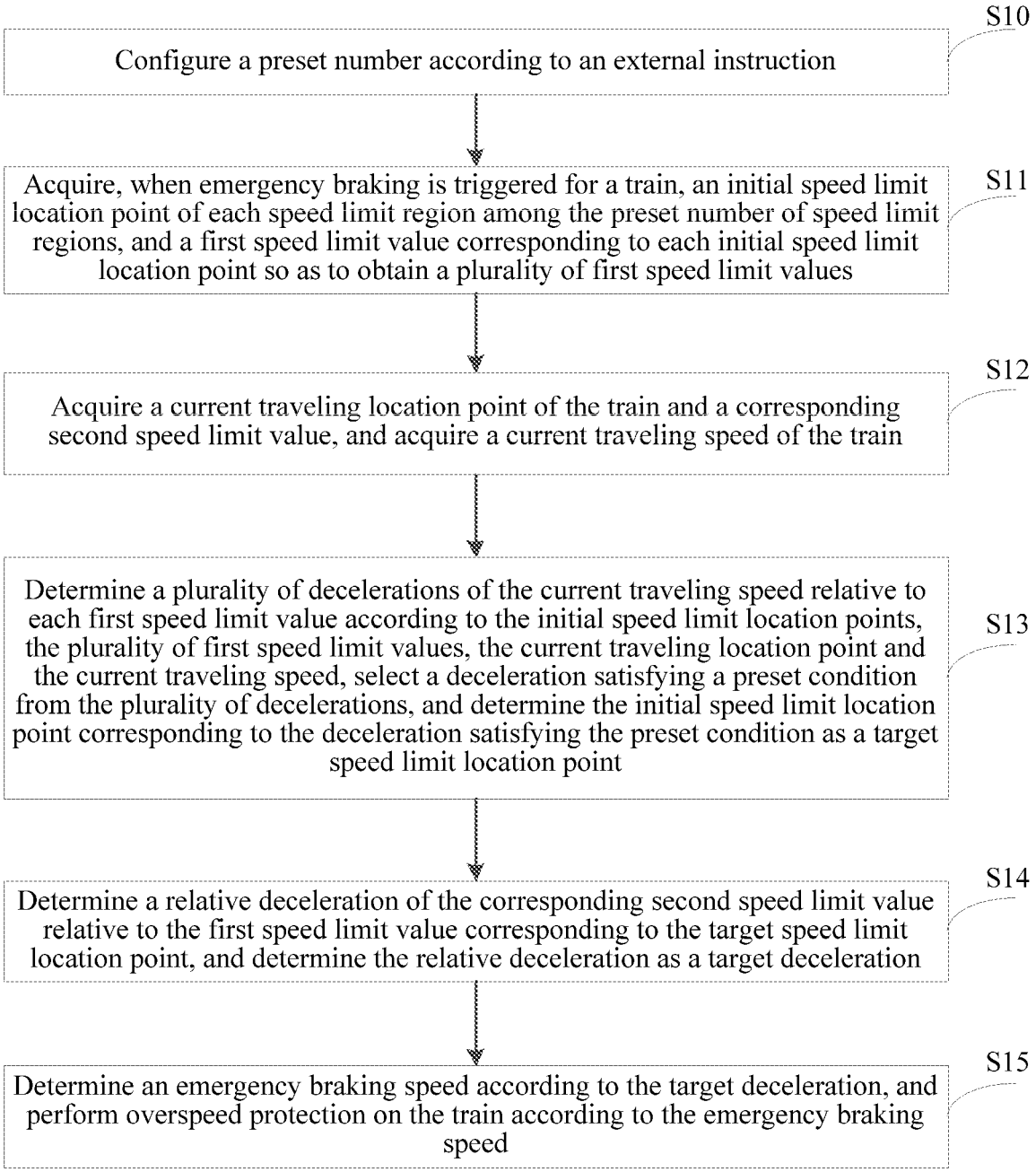
FIG. 2 is a schematic flow diagram of a train overspeed protection method according to another embodiment of the present subject matter.

In some embodiments, referring to FIG. 2, before step S11, the train overspeed protection method further includes:

S10: the preset number is configured according to an external instruction.

In the embodiment of the present subject matter, the external instruction may be triggered by related technical staff in a train control center, or by a driver of the train to set the number of speed limit regions acquired, which is not limited herein.

In this step, the flexibility and applicability of the method may be effectively improved by configuring the preset number according to the external instruction.

S12: a current traveling location point of the train and a corresponding second speed limit value are acquired, and a current traveling speed of the train is acquired.

In the embodiment of the present subject matter, the second speed limit value may be a minimum speed limit value of the train at the current traveling location point, for example, the second speed limit value may be marked as ssp.

In the embodiment, the current traveling speed may be marked as v, and the current traveling location point may be marked as pos.

S13: a plurality of decelerations of the current traveling speed relative to each first speed limit value are determined according to the initial speed limit location points, the plurality of first speed limit values, the current traveling location point and the current traveling speed, a deceleration satisfying a preset condition is selected from the plurality of decelerations, and the initial speed limit location point corresponding to the deceleration satisfying the preset condition is determined as a target speed limit location point.

In the embodiment of the present subject matter, the preset condition is that a minimum value among a plurality of decelerations of the current traveling speed relative to each first speed limit value is taken as a deceleration satisfying the preset condition.

In the embodiment of the present subject matter, the decelerations of the current traveling speed relative to each first speed limit value may be calculated according to the momentum conservation law.

In the embodiment, the current traveling speed of the train is v, and the first speed limit values corresponding to the initial speed limit location points $object_1$, $object_2$ and $object_3$ are respectively $V_1$, $V_2$ and $V_3$.

Then, the deceleration $a_1$ of the current traveling speed v relative to the first speed limit value $V_1$ is:

$$a_1=(v^2-V_1^2)/(\text{pos-object}_1); \quad (1)$$

The deceleration $a_2$ of the current traveling speed v relative to the first speed limit value $V_2$ is:

$$a_2=(v^2-V_2^2)/(\text{pos-object}_2); \quad (2)$$

The deceleration $a_3$ of the current traveling speed v relative to the first speed limit value $V_3$ is:

$$a_3=(v^2-V_3^2)/(\text{pos-object}_3); \quad (3)$$

$a_1$, $a_2$ and $a_3$ obtained in the above formulas (1), (2) and (3) are compared, and the minimum value among the three is taken as a deceleration satisfying the preset condition.

In the embodiment, the target speed limit location point may be marked as object, and the first speed limit value corresponding to the target speed limit location point is v_object. If $a_1<a_2<a_3$, the target speed limit location point object is the initial speed limit location point $object_1$ of the speed limit region, and the first speed limit value v_object corresponding to the target speed limit location point object is the first speed limit value $V_1$ corresponding to the initial speed limit location point $object_1$ of the speed limit region.

Further, a mobile authorized location, e.g., marked as ma, may also be acquired, a speed limit value corresponding to the mobile authorized location is 0, and a deceleration $a_4$ of the current traveling speed v relative to a speed limit value 0 of the mobile authorized location ma is:

$$a_4=(v^2-0)/(\text{pos-ma})=v^2/(\text{pos-ma}); \quad (4)$$

$a_1$, $a_2$, $a_3$ and $a_4$ obtained in the above formulas (1), (2), (3) and (4) are compared, and the minimum value among the four is taken as a deceleration satisfying the preset condition. For example, when $a_1<a_2<a_3<a_4$, the target speed limit location point object is the initial speed limit location point $object_1$ of the speed limit region, and the first speed limit value v_object corresponding to the target speed limit location point object is the first speed limit value $V_1$ corresponding to the initial speed limit location point $object_1$ of the speed limit region.

S14: a relative deceleration of the second speed limit value relative to the first speed limit value corresponding to the target speed limit location point is determined, and the relative deceleration is determined as a target deceleration.

In the embodiment, the target deceleration is marked as a_complate, and the relative deceleration a_complate of the second speed limit value ssp relative to first speed limit value v_object corresponding to the target speed limit location point object may be determined according to formula (5):

$$a_\text{complate}=(\text{ssp}^2-v_\text{object}^2)/(s-\text{object}); \quad (5)$$

s is a traveling distance from the emergency braking triggered for the train to the deceleration of the train to the first speed limit value v_object corresponding to the target speed limit location point object.

In the embodiment, the process from the emergency braking triggered for the train to the deceleration of the train to the first speed limit value v_object corresponding to the target speed limit location point object may be refined into four stages as follows:

First stage: out-of-control acceleration stage of the train, the train accelerates;

Second stage: idle stage of the train, the train travels at a constant speed;

Third stage: braking start stage of the train, the braking force of the train is from 0 to 100%;

Fourth stage: emergency braking stage of the train, the braking force of the train reaches 100%.

In the embodiment, a maximum acceleration of the train may be determined according to the performance of the train, for example, the maximum acceleration of the train is marked as a_max, the starting speed of the first stage is marked as $v_0$, that is, the starting speed of out-of-control acceleration of the train is $v_0$, the ending speed of the first stage is $v_1$, the traveling time of the first stage is $t_1$, and the traveling distance of the first stage is $s_1$, then:

$$v_1=v_0+t_1*a_\text{max}$$

$$s_1=t_1*(v_0+v_1)/2; \quad (6)$$

It may be appreciated that the starting speed of the second stage is $v_1$, the ending speed of the second stage is marked as $v_2$, the traveling time of the second stage is $t_2$, and the traveling distance of the second stage is $s_2$, then:

$$v_2=v_1$$

$$s_2=t_2*(v_1+v_2)/2; \quad (7)$$

It may be appreciated that the starting speed of the third stage is $v_2$, a maximum deceleration of the train is determined according to the performance of the train, for example, the maximum deceleration of the train is marked as $a_{eb}$, the acceleration of the train at the third stage is $a_{eb}/2$, the ending speed of the third stage is marked as $v_3$, the traveling time of the third stage is $t_3$, and the traveling distance of the third stage is $s_3$, then:

$$v_3=v_2+t_3*a_{eb}/2$$

$$s_3=t_3*(v_2+v_3)/2; \quad (8)$$

It may be appreciated that the starting speed of the fourth stage is $v_3$, the ending speed of the fourth stage is v_object, the acceleration of the train at the fourth stage is $a_{eb}$, and the traveling distance of the fourth stage is marked as $s_4$, then:

$$s_4=(v_\text{object}^2-v_3^2)/(2*a_{eb}); \quad (9)$$

The following formula may be obtained from formulas (6), (7), (8) and (9):

$$s=s_1+s_2+s_3+s_4; \quad (10)$$

S15: an emergency braking speed is determined according to the target deceleration, and overspeed protection is performed on the train according to the emergency braking speed.

For example, the emergency braking speed may be marked as v_limit.

In the embodiment, the emergency braking speed v_limit may be determined according to the target deceleration a_complate, and overspeed protection is performed on the train according to the emergency braking speed v_limit, thereby effectively improving the accuracy of emergency braking speed calculation, reducing the calculation cycle, improving the traveling safety and efficiency of the train, and improving riding comfort for users.

In the embodiment, the target deceleration may be compared with a preset deceleration; when the target deceleration is greater than the preset deceleration, the corresponding second speed limit value is determined as an emergency braking speed; when the target deceleration is smaller than or equal to the preset deceleration, a starting speed of out-of-control acceleration of the train before the emergency braking is triggered for the train is acquired, and the starting speed is determined as an emergency braking speed; and overspeed protection is performed on the train according to the emergency braking speed.

Figure 3:
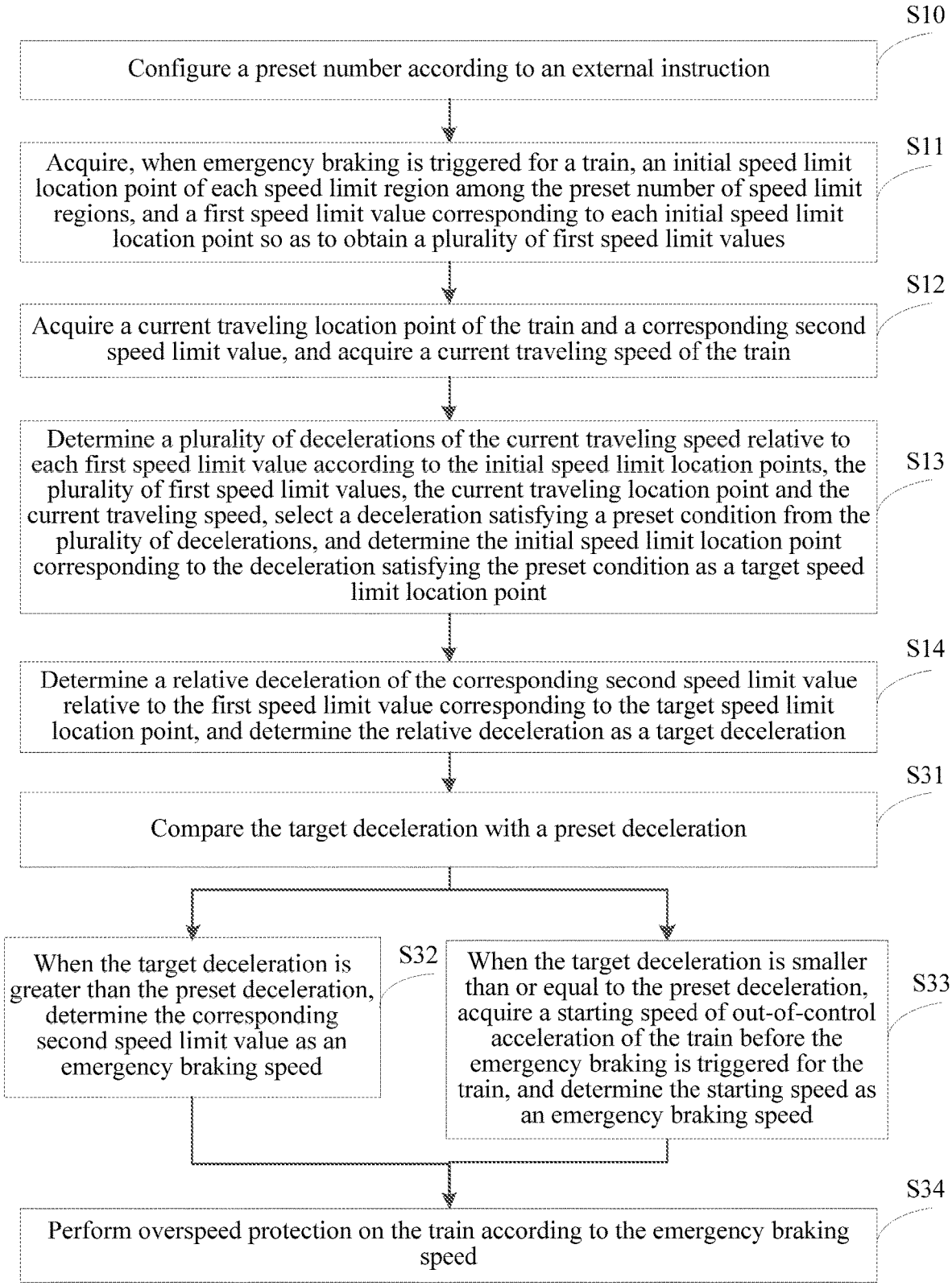
FIG. 3 is a schematic flow diagram of a train overspeed protection method according to a further embodiment of the present subject matter.

In some embodiments, referring to FIG. 3, step S15 specifically includes:

S31: the target deceleration is compared with a preset deceleration.

In the embodiment of the present subject matter, the preset deceleration is a maximum deceleration of the train determined according to the performance of the train, for example, the preset deceleration may be marked as $a_{eb}$.

Alternatively, a_complate is compared with $a_{eb}$ to obtain a comparison result a_complate>$a_{eb}$ or a_complate≤$a_{eb}$.

S32: when the target deceleration is greater than the preset deceleration, the corresponding second speed limit value is determined as an emergency braking speed.

Alternatively, when the target deceleration is greater than the preset deceleration, that is, a_complate>$a_{eb}$, the second speed limit value ssp corresponding to the current traveling location point of the train may be determined as an emergency braking speed v_limit.

S33: when the target deceleration is smaller than or equal to the preset deceleration, a starting speed of out-of-control acceleration of the train before the emergency braking is triggered for the train is acquired, and the starting speed is determined as an emergency braking speed.

Alternatively, when the target deceleration is smaller than or equal to the preset deceleration, that is, a_complate≤$a_{eb}$, a starting speed of out-of-control acceleration of the train before the emergency braking is triggered for the train may be acquired, i.e., $v_0$.

In the embodiment, a unary second-order equation as follows may be obtained according to formulas (6), (7), (8), (9) and (10) in step S14:

$$v_0^2+b*v_0+c=0; \tag{11}$$

wherein $$b=2*a_\max*t_1-a_{eb}*t_3-2*a_{eb}*(t_1+t_2)$$

$$c=2*a_{eb}*s+a_\max^2*t_1^2-a_{eb}*a_\max*t_1*(t_1+2*t_2+t_3)-a_{eb}^2*t_3^2/4; \tag{12}$$

Thus, the formulas (11) and (12) may be solved to obtain the value of $v_0$, and the starting speed $v_0$ is determined as an emergency braking speed v_limit.

S34: overspeed protection is performed on the train according to the emergency braking speed.

Alternatively, overspeed protection is performed on the train according to the emergency braking speed v_limit, thereby effectively improving the accuracy of emergency braking speed calculation and reducing the calculation cycle.

In this embodiment, the target deceleration is compared with the preset deceleration; when the target deceleration is greater than the preset deceleration, the corresponding second speed limit value is determined as an emergency braking speed; when the target deceleration is smaller than or equal to the preset deceleration, a starting speed of out-of-control acceleration of the train before the emergency braking is triggered for the train is acquired, and the starting speed is determined as an emergency braking speed; and overspeed protection is performed on the train according to the emergency braking speed, thereby effectively improving the accuracy of emergency braking speed calculation and reducing the calculation cycle.

In this embodiment, when emergency braking is triggered for a train, an initial speed limit location point of each speed limit region among a preset number of speed limit regions, and a first speed limit value corresponding to each initial speed limit location point are acquired so as to obtain a plurality of first speed limit values; a current traveling location point of the train and a corresponding second speed limit value are acquired, and a current traveling speed of the train is acquired; the initial speed limit location point corresponding to a deceleration satisfying a preset condition among a plurality of decelerations of the current traveling speed relative to each first speed limit value is determined as a target speed limit location point; an emergency braking speed is determined according to a relative deceleration of the second speed limit value relative to the first speed limit value corresponding to the target speed limit location point, and overspeed protection is performed on the train according to the emergency braking speed, thereby effectively improving the accuracy of emergency braking speed calculation, reducing the calculation cycle, improving the traveling safety and efficiency of the train, and improving riding comfort for users.

Figure 4:
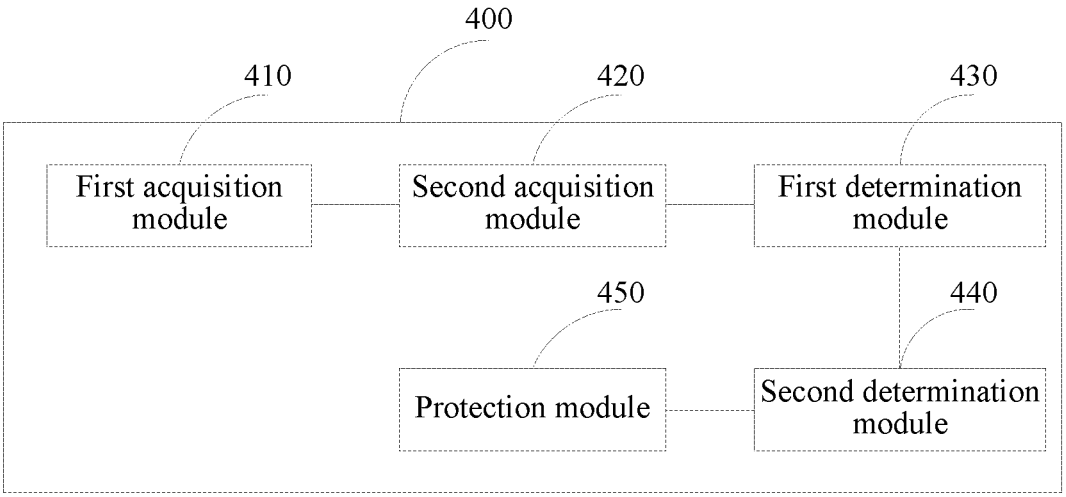
FIG. 4 is a schematic structural diagram of a train overspeed protection apparatus according to an embodiment of the present subject matter.

FIG. 4 is a schematic structural diagram of a train overspeed protection apparatus according to an embodiment of the present subject matter. The train overspeed protection apparatus 400 may be implemented by software, hardware, or a combination of both.

Referring to FIG. 4, the train overspeed protection apparatus 400 includes:

a first acquisition module 410, configured to acquire, when emergency braking is triggered for a train, an initial speed limit location point of each speed limit region among a preset number of speed limit regions, and a first speed limit value corresponding to each initial speed limit location point so as to obtain a plurality of first speed limit values;

a second acquisition module 420, configured to acquire a current traveling location point of the train and a corresponding second speed limit value, and acquire a current traveling speed of the train;

a first determination module 430, configured to determine a plurality of decelerations of the current traveling speed relative to each first speed limit value according to the initial speed limit location points, the plurality of first speed limit values, the current traveling location point and the current traveling speed, select a deceleration satisfying a preset condition from the plurality of decelerations, and determine the initial speed limit location point corresponding to the deceleration satisfying the preset condition as a target speed limit location point, wherein alternatively, the preset condition is that a minimum value among a plurality of decelerations of the current traveling speed relative to each first speed limit value is taken as a deceleration satisfying the preset condition;

a second determination module 440, configured to determine a relative deceleration of the second speed limit value of the train relative to the first speed limit value corresponding to the target speed limit location point, and determine the relative deceleration as a target deceleration; and a protection module 450, configured to determine an emergency braking speed according to the target deceleration, and perform overspeed protection on the train according to the emergency braking speed.

Figure 5:
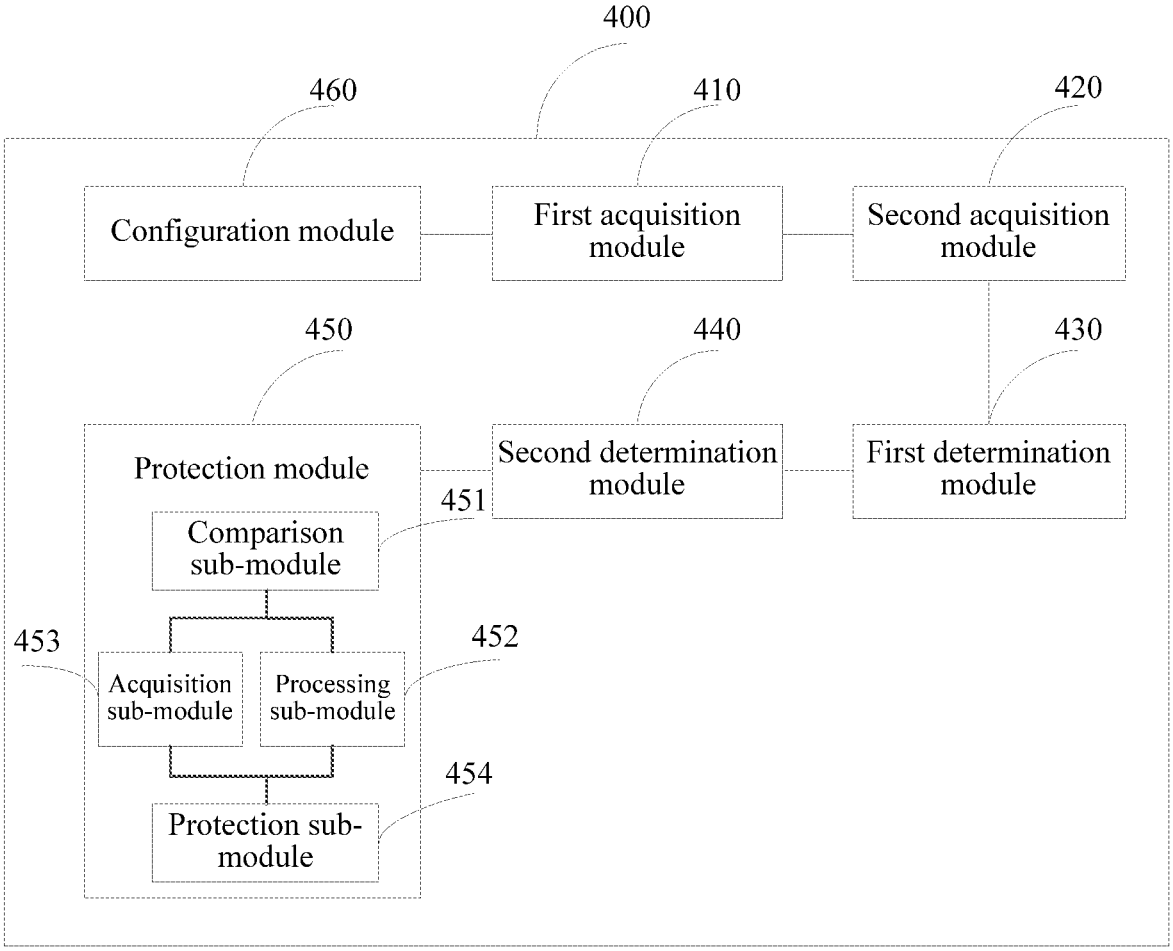
FIG. 5 is a schematic structural diagram of a train overspeed protection apparatus according to another embodiment of the present subject matter.

In some embodiments, referring to FIG. 5, the train overspeed protection apparatus 400 may further include a configuration module 460.

Alternatively, the protection module 450 includes:

a comparison sub-module 451, configured to compare the target deceleration with a preset deceleration, wherein alternatively, the preset deceleration is a maximum deceleration of the train determined according to the performance of the train;

a processing sub-module 452, configured to determine, when the target deceleration is greater than the preset deceleration, the corresponding second speed limit value as an emergency braking speed;

an acquisition sub-module 453, configured to acquire, when the target deceleration is smaller than or equal to the preset deceleration, a starting speed of out-of-control acceleration of the train before the emergency braking is triggered for the train, and determine the starting speed as an emergency braking speed; and a protection sub-module 454, configured to perform overspeed protection on the train according to the emergency braking speed.

The configuration module 460 is configured to configure the preset number according to an external instruction.

It should be noted that the descriptions of the train overspeed protection method in the foregoing embodiments of FIG. 1 to FIG. 3 are also applicable to the train overspeed protection apparatus 400 of this embodiment, the implementation principle thereof is similar, and details are not described herein again.

In this embodiment, when emergency braking is triggered for a train, an initial speed limit location point of each speed limit region among a preset number of speed limit regions, and a first speed limit value corresponding to each initial speed limit location point are acquired so as to obtain a plurality of first speed limit values; a current traveling location point of the train and a corresponding second speed limit value are acquired, and a current traveling speed of the train is acquired; the initial speed limit location point corresponding to a deceleration satisfying a preset condition among a plurality of decelerations of the current traveling speed relative to each first speed limit value is determined as a target speed limit location point; an emergency braking speed is determined according to a relative deceleration of the second speed limit value relative to the first speed limit value corresponding to the target speed limit location point, and overspeed protection is performed on the train according to the emergency braking speed, thereby effectively improving the accuracy of emergency braking speed calculation, reducing the calculation cycle, improving the traveling safety and efficiency of the train, and improving riding comfort for users.

An embodiment of the present subject matter further provides a computer readable non-transitory storage medium storing executable instructions that, when executed by a processor, implement the train overspeed protection method as described in the above embodiments.

It should be noted that in the description of the present subject matter, the terms such as "first" and "second" are used for the purpose of description only and are not to be construed as indicating or implying relative importance. In addition, in the description of the present subject matter, unless otherwise indicated, the meaning of "a plurality" is two or more.

Any process or method description in the flowchart or otherwise described herein may be construed as representing modules, segments, or portions of code comprising one or more executable instructions for implementing the steps of a particular logical function or process, and the scope of the preferred embodiments of the present subject matter includes additional implementations. The functions may not be performed in the order shown or discussed. For example, the functions involved may be performed in a substantially simultaneous manner or in a reverse order. This should be understood by those skilled in the art to which the embodiments of the present subject matter pertain.

It is to be understood that portions of the present subject matter may be implemented through hardware, software, firmware, or a combination thereof. In the embodiments described above, various steps or methods may be implemented by software or firmware stored in a memory and executed by a suitable instruction execution system. For example, if implemented through hardware, as in another embodiment, the operations or methods may be implemented using any one or a combination of the following techniques known in the art: a discrete logic circuit having a logic gate for implementing a logic function on data signals, an application-specific integrated circuit having an appropriate combinational logic gate circuit, a programmable gate array (PGA), a field programmable gate array (FPGA), and the like.

A person of ordinary skill in the art may understand that all or some of the steps of the methods in the embodiments may be implemented by a program instructing relevant hardware. The program may be stored in a computer readable storage medium. When the program is executed, one or a combination of the steps of the method embodiments are performed.

In addition, functional units in the embodiments of the present subject matter may be integrated into one processing module, or each of the units may exist alone physically, or two or more units may be integrated into one module. The integrated module may be implemented in a form of hardware, or may be implemented in a form of a software functional module. When the integrated module is implemented in the form of a software functional module and sold or used as an independent product, the integrated module may be stored in a computer-readable storage medium.

The storage medium mentioned above may be a read-only memory, a magnetic disk, an optical disc, or the like.

In the description of the specification, the description made with reference to terms such as "one embodiment", "some embodiments", "example", "specific example", or "some examples" means that a specific characteristic, structure, material or feature described with reference to the embodiment or example is included in at least one embodiment or example of the present subject matter. In this specification, exemplary descriptions of the foregoing terms do not necessarily refer to a same embodiment or example. In addition, the described specific features, structures, materials, or characteristics may be combined in an appropriate manner in any one or multiple embodiments or examples.

Although the embodiments of the present subject matter are shown and described above, it can be understood that, the foregoing embodiments are exemplary, and cannot be construed as a limitation to the present subject matter. Within the scope of the present subject matter, a person of ordinary skill in the art may make changes, modifications, replacement, and variations to the foregoing embodiments.

What is claimed is:

1. A train overspeed protection method, comprising the following steps:

acquiring, when emergency braking is triggered for a train, an initial speed limit location point of each speed limit region among a preset number of speed limit regions, and a first speed limit value corresponding to each initial speed limit location point so as to obtain a plurality of first speed limit values;

acquiring a current traveling location point of the train and a corresponding second speed limit value, and acquiring a current traveling speed of the train;

determining a plurality of decelerations of the current traveling speed relative to each first speed limit value according to the initial speed limit location points, the plurality of first speed limit values, the current traveling location point, and the current traveling speed, selecting a deceleration satisfying a preset condition from the plurality of decelerations, and setting the initial speed limit location point corresponding to the deceleration satisfying the preset condition as a target speed limit location point;

determining a relative deceleration of the corresponding second speed limit value relative to the first speed limit value corresponding to the target speed limit location point, and setting the relative deceleration as a target deceleration; and determining an emergency braking speed according to the target deceleration by acquiring a starting speed of out-of-control acceleration of the train before the emergency braking is triggered for the train and comparing the target deceleration with a preset deceleration, and performing overspeed protection on the train according to the emergency braking speed, wherein the starting speed is set as the emergency braking speed upon identifying that the target deceleration is smaller than or equal to the preset deceleration, wherein the corresponding second speed limit value is set as the emergency braking speed upon identifying that the target deceleration is greater than the preset deceleration.

2. The train overspeed protection method according to claim 1, wherein a minimum value among the plurality of decelerations of the current traveling speed relative to each first speed limit value is taken as a deceleration satisfying the preset condition.

3. The train overspeed protection method according to claim 1, wherein the preset deceleration is a maximum deceleration of the train determined according to the performance of the train.

4. The train overspeed protection method according to claim 1, wherein before acquiring the initial speed limit location point of each speed limit region among the preset number of speed limit regions, the method further comprises:

setting the preset number according to an external instruction.

5. A train overspeed protection apparatus, comprising:

a first acquisition module, configured to acquire, when emergency braking is triggered for a train, an initial speed limit location point of each speed limit region among a preset number of speed limit regions, and a first speed limit value corresponding to each initial speed limit location point so as to obtain a plurality of first speed limit values;

a second acquisition module, configured to acquire a current traveling location point of the train and a corresponding second speed limit value, and acquire a current traveling speed of the train;

a first determination module, configured to determine a plurality of decelerations of the current traveling speed relative to each first speed limit value according to the initial speed limit location points, the plurality of first speed limit values, the current traveling location point, and the current traveling speed, select a deceleration satisfying a preset condition from the plurality of decelerations, and set the initial speed limit location point corresponding to the deceleration satisfying the preset condition as a target speed limit location point, a second determination module, configured to determine a relative deceleration of the corresponding second speed limit value relative to the first speed limit value corresponding to the target speed limit location point, and set the relative deceleration as a target deceleration; and a protection module, configured to determine an emergency braking speed according to the target deceleration, and perform overspeed protection on the train according to the emergency braking speed, wherein the protection module includes:

a comparison sub-module that compares the target deceleration with a preset deceleration;

a processing sub-module that sets the corresponding second speed limit value as the emergency braking speed upon identifying that the target deceleration is greater than the preset deceleration;

an acquisition sub-module that acquires a starting speed of out-of-control acceleration of the train before the emergency braking is triggered for the train, and sets the starting speed as the emergency braking speed upon identifying that the target deceleration is smaller than or equal to the preset deceleration; and a protection sub-module, configured to perform the overspeed protection on the train according to the emergency braking speed.

6. The train overspeed protection apparatus according to claim 5, wherein a minimum value among the plurality of decelerations of the current traveling speed relative to each first speed limit value is taken as the deceleration satisfying the preset condition.

7. The train overspeed protection apparatus according to claim 5, wherein the preset deceleration is a maximum deceleration of the train determined according to the performance of the train.

8. The train overspeed protection apparatus according to claim 5, further comprising:

a configuration module, configured to configure the preset number according to an external instruction.

9. A computer readable non-transitory storage medium storing executable instructions that, when executed by a processor, implement the method according to claim 1.

10. The train overspeed protection method according to claim 3, wherein before acquiring the initial speed limit location point of each speed limit region among the preset number of speed limit regions, the method further comprises:

configuring the preset number according to an external instruction.

* * * * *